US006079898A

United States Patent [19]

St. Amant, III

[11] Patent Number: 6,079,898

[45] Date of Patent: Jun. 27, 2000

[54] ROADWAY COVER SYSTEM FOR UTILITY LINES

[76] Inventor: Dennis J. St. Amant, III, 809 Gassen St., Luling, La. 70070

[21] Appl. No.: 09/243,527

[22] Filed: Feb. 1, 1999

[51] Int. Cl.[7] ..... E01F 13/00

[52] U.S. Cl. ..... 404/6; 404/9

[58] Field of Search ..... 404/6, 8, 9, 3; 174/38, 39, 48, 49, 72 C, 95, 101, 100

[56] References Cited

U.S. PATENT DOCUMENTS

| | | | |
|---|---|---|---|
| D. 218,075 | 7/1970 | Valley | D29/99 |
| D. 322,414 | 12/1991 | Scratcher | D10/113 |
| D. 348,230 | 6/1994 | Shairba | D10/113 |
| D. 351,422 | 10/1994 | Morris | D20/10 |
| D. 391,513 | 3/1998 | Brown | D10/113 |
| 1,881,376 | 10/1932 | Hunter . | |
| 2,287,685 | 6/1942 | Jelinek | 404/6 |
| 2,440,668 | 4/1948 | Tarbox | 404/6 |
| 2,666,373 | 1/1954 | Mattson | 94/1.5 |
| 2,920,184 | 1/1960 | Kessler | 240/2 |
| 3,052,248 | 9/1962 | Reuter | 134/199 |
| 3,712,187 | 1/1973 | Stelling | 94/4 |
| 4,605,336 | 8/1986 | Slaw, Sr. | 404/6 |
| 4,942,271 | 7/1990 | Corsi et al. | 174/101 |
| 5,267,367 | 12/1993 | Wegmann, Jr. | 14/69.5 |
| 5,639,179 | 6/1997 | Jensen | 404/6 |

*Primary Examiner*—Eileen Dunn Lillis
*Assistant Examiner*—Raymond W Addie
*Attorney, Agent, or Firm*—Joseph N. Breaux

[57] ABSTRACT

A roadway cover system for protecting sections of utility lines run across roadways or the like that includes a ramp structure having a protected passageway through which the utility lines can be routed. To prevent the utility lines from abrasive rubbing contact with the roadway surface, the ramp structure is provided with a resilient protective shield that, in use, is positioned between the utility line and the roadway to protect the utility line from abrasive rubbing contact with the roadway surface.

1 Claim, 3 Drawing Sheets

FIG.2
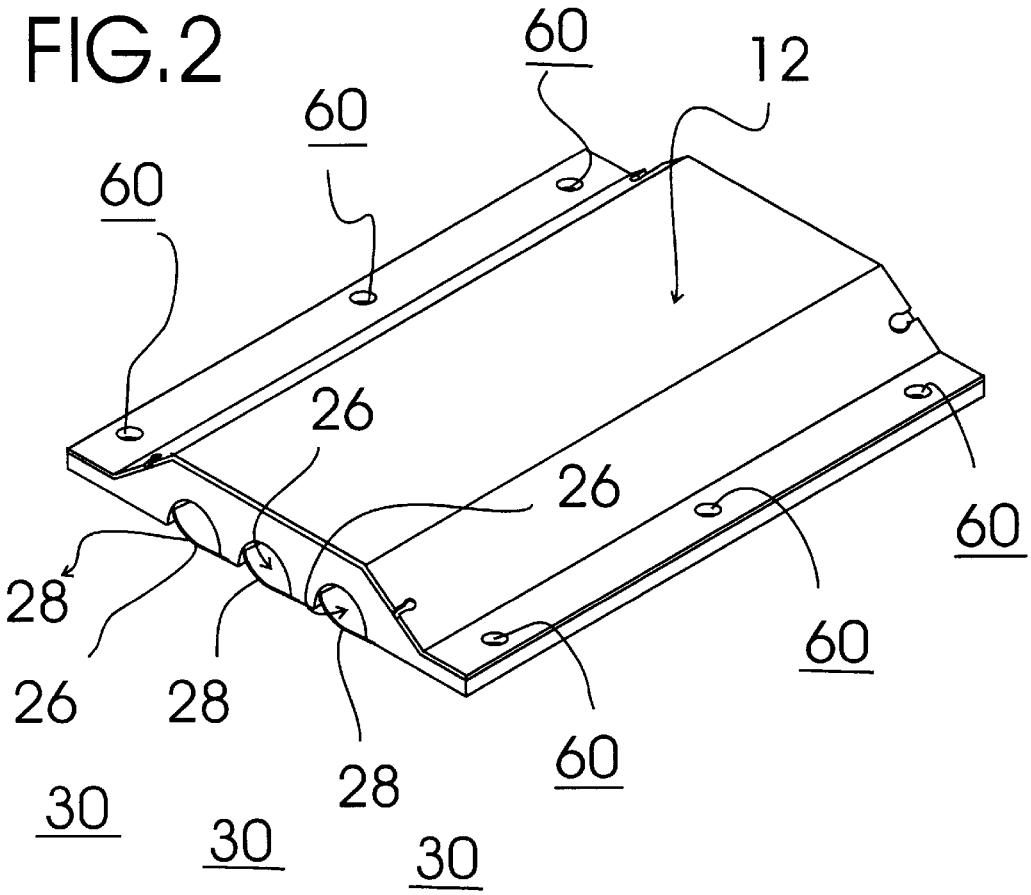
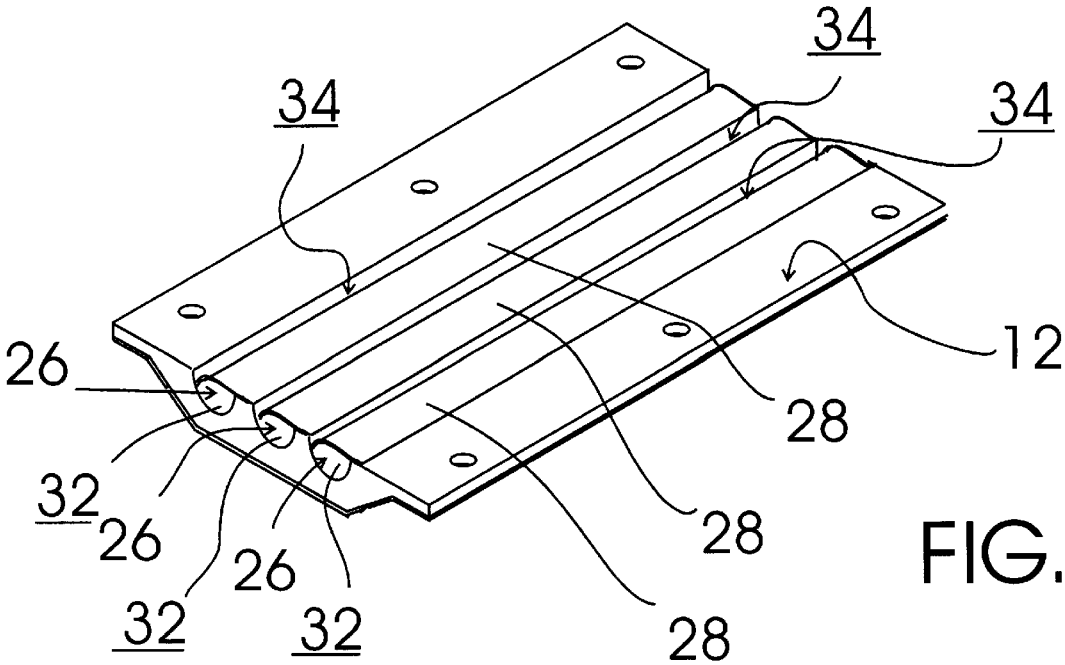
FIG.3

ROADWAY COVER SYSTEM FOR UTILITY LINES

TECHNICAL FIELD

The present invention relates to protective structures for temporary utility lines, such as water, electrical, gas, etc., that are run over roadways and more particularly to a roadway cover system for utility lines that includes two identical connecting keys each having a center portion positioned between two mirror image end portions, and two identical ramp structures each including two end panels having securing stake apertures formed therethrough, two angled panels each having two collinearly aligned keyways formed into opposed side edges thereof that are shaped to receive in registration on-half of one of the two connecting keys and being alignable with a keyway of another ramp structure, a raised center panel, a semi-cylindrical utility line passageway defined by a passageway wall and having open front and back ends and a longitudinal opening along the entire length thereof, and a resilient flexible flap; the resilient flexible flap being installed across the longitudinal opening of the utility line passageway such that a free end of each flap is curled into the utility line passageway and held within the utility line passageway by contact between the free end and the passageway wall; the two angled panels being formed on opposed sides of the center panel; each end panel being formed in connection with an angled panel along a side of the angled panel opposite the center panel.

BACKGROUND ART

It is often necessary at construction sites, emergency locations, plants, etc. to run utility lines supplying water, steam, electricity, gas, etc. across roadways between the source of the utility and the site where the utility is used. Although the utility lines effectively transport the utility across the roadway, vehicles rolling over the utility lines can damage and in some cases rupture or break the utility lines leading to interruptions in the utility. It would be a benefit, therefore, to have a cover system that could be positioned over the utility lines that would provide a ramp structure over the utility lines to support the wheels of crossing vehicles without bearing upon the utility lines and provide a protected passageway through which the utility lines could be routed. Because the ramp structure is susceptible of moving back and forth when rolled over by vehicles, it would be a further benefit to have a ramp structure including a protected passageway through which the utility lines could be routed that included a resilient protective shield that, in use, was positioned between the utility line and the roadway to protect the utility line from abrasive rubbing contact with the roadway surface.

GENERAL SUMMARY DISCUSSION OF INVENTION

It is thus an object of the invention to provide a roadway cover system for utility lines that includes a ramp structure having a protected passageway through which the utility lines can be routed.

It is a further object of the invention to provide a roadway cover system for utility lines that includes a ramp structure including a protected passageway through which the utility lines are routed that includes a resilient protective shield that, in use, is positioned between the utility line and the roadway to protect the utility line from abrasive rubbing contact with the roadway surface.

It is a still further object of the invention to provide a roadway cover system for utility lines that includes two identical connecting keys each having a center portion positioned between two mirror image end portions, and two identical ramp structures each including two end panels having securing stake apertures formed therethrough, two angled panels each having two collinearly aligned keyways formed into opposed side edges thereof that are shaped to receive in registration on-half of one of the two connecting keys and being alignable with a keyway of another ramp structure, a raised center panel, a semi-cylindrical utility line passageway defined by a passageway wall and having open front and back ends and a longitudinal opening along the entire length thereof, and a resilient flexible flap; the resilient flexible flap being installed across the longitudinal opening of the utility line passageway such that a free end of each flap is curled into the utility line passageway and held within the utility line passageway by contact between the free end and the passageway wall; the two angled panels being formed on opposed sides of the center panel; each end panel being formed in connection with an angled panel along a side of the angled panel opposite the center panel.

It is a still further object of the invention to provide a roadway cover system for utility lines that accomplishes all or some of the above objects in combination.

Accordingly, a roadway cover system for utility lines is provided. The roadway cover system for utility lines includes two identical connecting keys each having a center portion positioned between two mirror image end portions, and two identical ramp structures each including two end panels having securing stake apertures formed therethrough, two angled panels each having two collinearly aligned keyways formed into opposed side edges thereof that are shaped to receive in registration on-half of one of the two connecting keys and being alignable with a keyway of another ramp structure, a raised center panel, a semi-cylindrical utility line passageway defined by a passageway wall and having open front and back ends and a longitudinal opening along the entire length thereof, and a resilient flexible flap; the resilient flexible flap being installed across the longitudinal opening of the utility line passageway such that a free end of each flap is curled into the utility line passageway and held within the utility line passageway by contact between the free end and the passageway wall; the two angled panels being formed on opposed sides of the center panel; each end panel being formed in connection with an angled panel along a side of the angled panel opposite the center panel.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein:

FIG. 2 is a perspective view of the upper surface of the exemplary embodiment of the ramp structure of the roadway cover system of FIG. 1 in isolation showing the two end panels, the two angled panels, the raised center panel, three semi-cylindrical utility line passageways each having a resilient, flexible protective flap, four connecting keyways, and six securing stake apertures.

FIG. 3 is an underside perspective view of the exemplary embodiment of the ramp structure of the roadway cover system of FIG. 1 in isolation showing the three semi-cylindrical utility line passageways formed across the entire width of the ramp structure, each having a resilient, flexible protective flap positioned along the length thereof.

EXEMPLARY MODE FOR CARRYING OUT THE INVENTION

Figure 1:
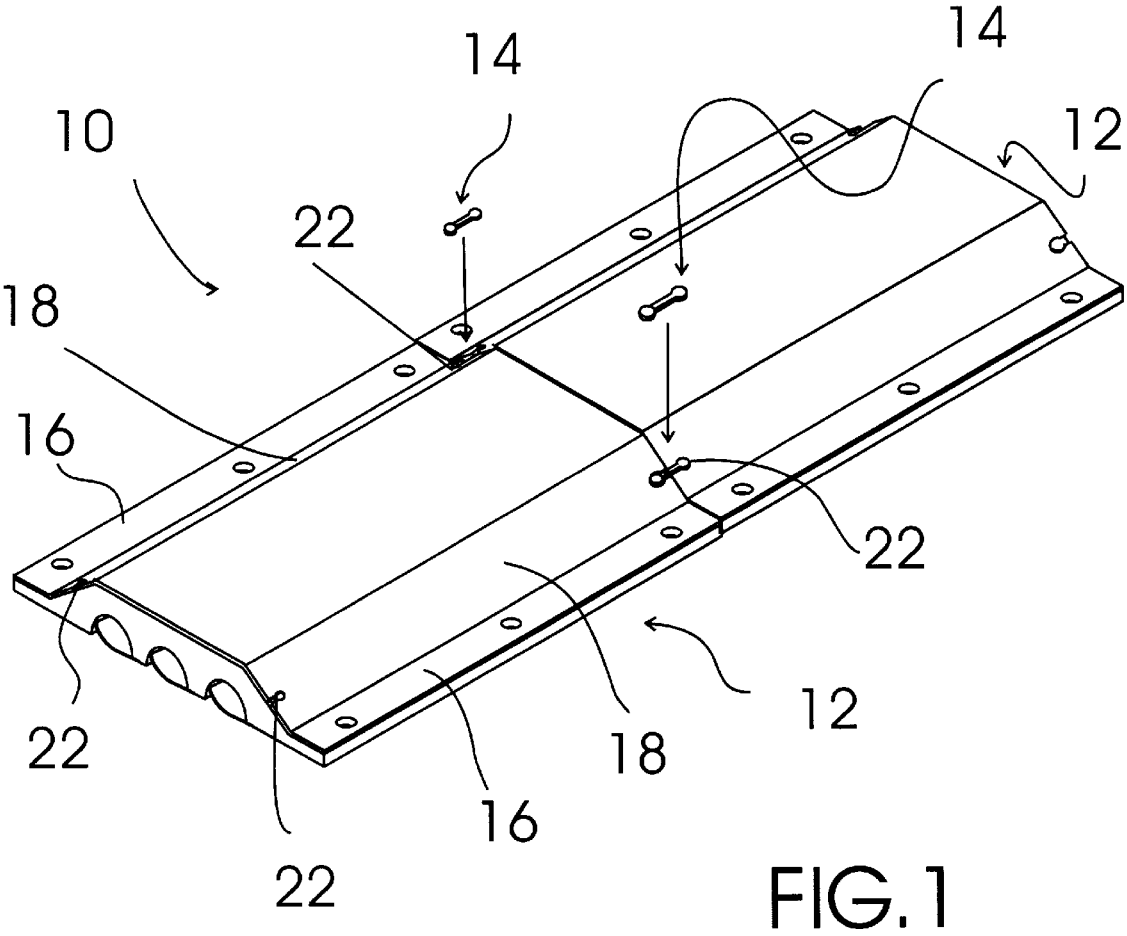
FIG. 1 is a perspective view of an exemplary embodiment of the roadway cover system for utility lines of the present invention showing two identical ramp structures positioned end to end with two of the identical connecting keyways of each ramp structure aligned with two connecting keyways of the other ramp structure and two exemplary circular ended connecting keys of the roadway cover system positioned above each of the aligned pairs of keyways.

FIG. 1 shows an exemplary embodiment of the roadway cover system for utility lines of the present invention generally designated 10. Roadway cover system 10 includes two identical ramp structures, each generally designated 12, and two identical connecting keys, each generally designated 14. Each ramp structure 12 includes two end panels 16, two angled panels 18, and a raised center panel 20. End panels 16 and center panel 20 are oriented in parallel. Angled panels 18 each include two collinearly oriented keyways 22 that are shaped to receive in registration one-half of a connecting key 14.

Figure 4:
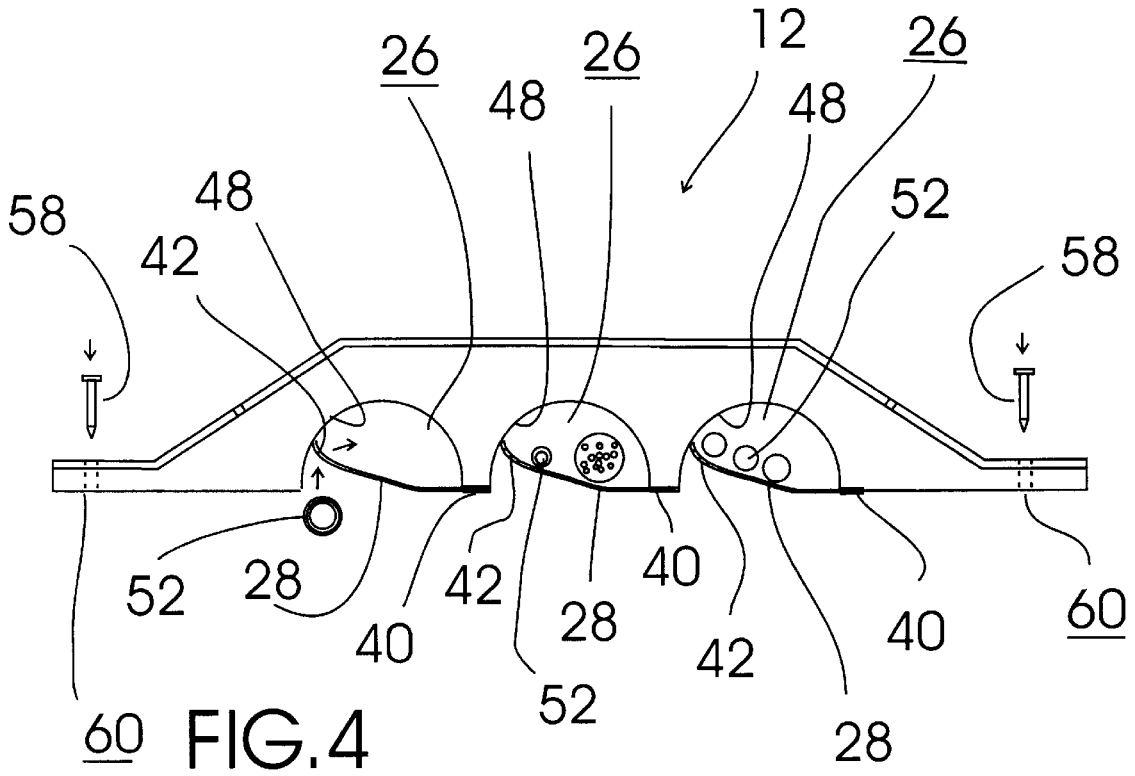
FIG. 4 is an end plan view of the ramp structure of FIGS. 1,2 and 3 showing two representative securing stakes used in connection with the securing stake apertures for securing the ramp structure in place, and two of the three resilient, flexible protective flaps supporting utility lines within two of the three semi-cylindrical utility line passageways and providing a flexible protective barrier between the utility lines and the rough roadway surface.

Referring now to FIG. 2, in this embodiment each ramp structure 12 includes three semi-cylindrical utility line passageways 26 each having a resilient, flexible plastic protective flap 28. Referring now to FIG. 3, each of the three semi-cylindrical utility line passageways 26 is formed across the entire width of ramp structure 12 and has an open front end 30 (FIG. 2) and open back end 32, and a longitudinal opening 34 formed along the entire length thereof. Referring to FIG. 4, each resilient flexible plastic flap 28 has an attachment end 40 permanently secured to ramp structure 12 and a free end 42. Each resilient flexible plastic flap 28 is installed across a respective longitudinal opening 34 (FIG. 3) of a utility line passageway 26 such that free end 42 of each flap 28 is curled into utility line passageway 26 and held within utility line passageway 26 by contact between free end 26 and the passageway wall 48. In use, utility lines 52 are inserted into utility line passageway 26 laterally through longitudinal opening 34 (FIG. 3) by pushing it laterally past free end 42 between free end 42 and passageway wall 48. Once utility line 52 is past free end 42, free end 42 resiliently returns back to its initial position in contact with passageway wall 48 trapping utility line 52 within utility line passageway 26. When thus trapped, resilient, flexible plastic protective flap 28 is positioned between utility line 52 and the roadway surface and protects utility line 52 from abrasive contact with the roadway. To minimize movement of ramp structure 12 caused by moving vehicles, ramp structure 12 can be anchored in place with stakes 58 by hammering stakes 58 through securing stake apertures 60 (shown more clearly in FIG. 2).

It can be seen from the preceding description that a roadway cover system for utility lines has been provided that includes a ramp structure having a protected passageway through which the utility lines can be routed; that includes a ramp structure including a protected passageway through which the utility lines are routed that includes a resilient protective shield that, in use, is positioned between the utility line and the roadway to protect the utility line from abrasive rubbing contact with the roadway surface; and that includes two identical connecting keys each having a center portion positioned between two mirror image end portions, and two identical ramp structures each including two end panels having securing stake apertures formed therethrough, two angled panels each having two collinearly aligned keyways formed into opposed side edges thereof that are shaped to receive in registration on-half of one of the two connecting keys and being alignable with a keyway of another ramp structure, a raised center panel, a semi-cylindrical utility line passageway defined by a passageway wall and having open front and back ends and a longitudinal opening along the entire length thereof, and a resilient flexible flap; the resilient flexible flap being installed across the longitudinal opening of the utility line passageway such that a free end of each flap is curled into the utility line passageway and held within the utility line passageway by contact between the free end and the passageway wall; the two angled panels being formed on opposed sides of the center panel; each end panel being formed in connection with an angled panel along a side of the angled panel opposite the center panel.

It is noted that the embodiment of the roadway cover system for utility lines described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A roadway cover system for utility lines comprising:

two identical connecting keys each having a center portion positioned between two mirror image end portions; and two identical ramp structures each including two end panels having securing stake apertures formed therethrough, two angled panels each having two collinearly aligned keyways formed into opposed side edges thereof that are shaped to receive in registration one-half of one of said two connecting keys and being alignable with a keyway of another ramp structure, a raised center panel, a plurality of semi-cylindrical utility line passageways, each of said plurality of semi-cylindrical utility line passageways are defined by a passageway wall and having open front and back ends and a longitudinal opening along the entire length thereof, each of said plurality of semi-cylindrical utility line passageways further comprise and a resilient flexible flap;

said resilient flexible flap being installed across said longitudinal opening of said utility line passageway such that a free end of each flap is curled into said utility line passageway and held within said utility line passageway by contact between said free end and said passageway wall;

said two angled panels being formed on opposed sides of said center panel;

each said end panel being formed in connection with a said angled panel along a side of said angled panel opposite said center panel.

* * * * *